US008502467B2

(12) United States Patent
Lin

(10) Patent No.: US 8,502,467 B2
(45) Date of Patent: Aug. 6, 2013

(54) CONTROLLER FOR A LIGHT FIXTURE

(76) Inventor: Kuo-Tsun Lin, Taichung (TW)

( * ) Notice: Subject to any disclaimer, the term of this patent is extended or adjusted under 35 U.S.C. 154(b) by 238 days.

(21) Appl. No.: 13/089,598

(22) Filed: Apr. 19, 2011

(65) Prior Publication Data

US 2012/0268009 A1 Oct. 25, 2012

(51) Int. Cl.
*H05B 37/04* (2006.01)

(52) U.S. Cl.
USPC ..... 315/291; 315/91; 315/89; 315/250; 315/297; 315/308

(58) Field of Classification Search
USPC ..... 315/291, 88–92, 210, 195, 250, 297, 315/308
See application file for complete search history.

(56) References Cited

U.S. PATENT DOCUMENTS

| | | | | |
|---|---|---|---|---|
| 5,914,572 | A * | 6/1999 | Qian et al. | 315/307 |
| 6,285,139 | B1 * | 9/2001 | Ghanem | 315/291 |
| 2008/0136350 | A1 * | 6/2008 | Tripathi et al. | 315/294 |

* cited by examiner

*Primary Examiner* — Daniel D Chang
(74) *Attorney, Agent, or Firm* — Fox Rothschild, LLP; Robert J. Sacco

(57) ABSTRACT

A controller for a light fixture includes: a current-sampling circuit adapted to be connected electrically to the light fixture, and operable to generate a voltage signal corresponding to a current flowing through a light source of the light fixture; a voltage-processing circuit operable to perform at least one of voltage-amplification and voltage-rectification processes upon the voltage signal so as to generate a recognition signal; a signal-recognition unit configured to generate a control signal according to the recognition signal; a driver unit operable to generate a driver signal corresponding to the control signal; and a driving component adapted to be connected electrically to the light fixture, and driven by the driver signal for controlling operation of the light source of the light fixture.

4 Claims, 3 Drawing Sheets

CONTROLLER FOR A LIGHT FIXTURE

BACKGROUND OF THE INVENTION

1. Field of the Invention

The present invention relates to a controller for a light fixture, more particularly to a controller capable of controlling operation of a light source of a light fixture based on a current flowing through the light source.

2. Description of the Related Art

Generally, ceiling fans with light fixtures are adapted for installation of incandescent lamps and electronic energy saving lamps, which have different control methods. Specifically, incandescent lamps are dimmable (i.e., brightness adjustable) while most electronic energy saving lamps are not. Moreover, since incandescent lamps and electronic energy saving lamps correspond to the same type of lamp socket, one may inadvertently insert an incandescent lamp into a socket for an electronic energy saving lamp, or an electronic energy saving lamp into a socket for an incandescent lamp, which may consequently damage the control circuit and/or may shorten service life of the lamp.

In addition, according to experiments, several commercially available electronic energy saving lamps generate electromagnetic noise during operation when inserted into sockets with brightness adjustment control. Furthermore, the electromagnetic noise thus generated is transmitted via power cables, which may affect operations of other nearby electrical appliances. From the aspect of manufacturers, manufacturing different types of light fixtures to suit the different control methods of different lamp types may result in problems of overstock and increased production costs.

SUMMARY OF THE INVENTION

Therefore, an object of the present invention is to provide a controller capable of alleviating the aforesaid drawbacks of the prior art.

Accordingly, a controller for alight fixture of the present invention comprises:

- a current-sampling circuit adapted to be connected electrically to the light fixture, and operable to generate a voltage signal corresponding to a current flowing through a light source of the light fixture;
- a voltage-processing circuit connected electrically to the current-sampling circuit for receiving the voltage signal therefrom, and operable to perform one of a voltage-amplification process, a voltage-rectification process, and a combination thereof upon the voltage signal so as to generate a recognition signal;
- a signal-recognition unit connected electrically to the voltage-processing circuit for receiving the recognition signal therefrom, and configured to generate a control signal according to the recognition signal;
- a driver unit connected electrically to the signal-recognition unit for receiving the control signal therefrom, and operable to generate a driver signal corresponding to the control signal; and
- a driving component connected electrically to the driver unit for receiving the driver signal therefrom, adapted to be connected electrically to the light fixture, and driven by the driver signal for controlling operation of the light source of the light fixture.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
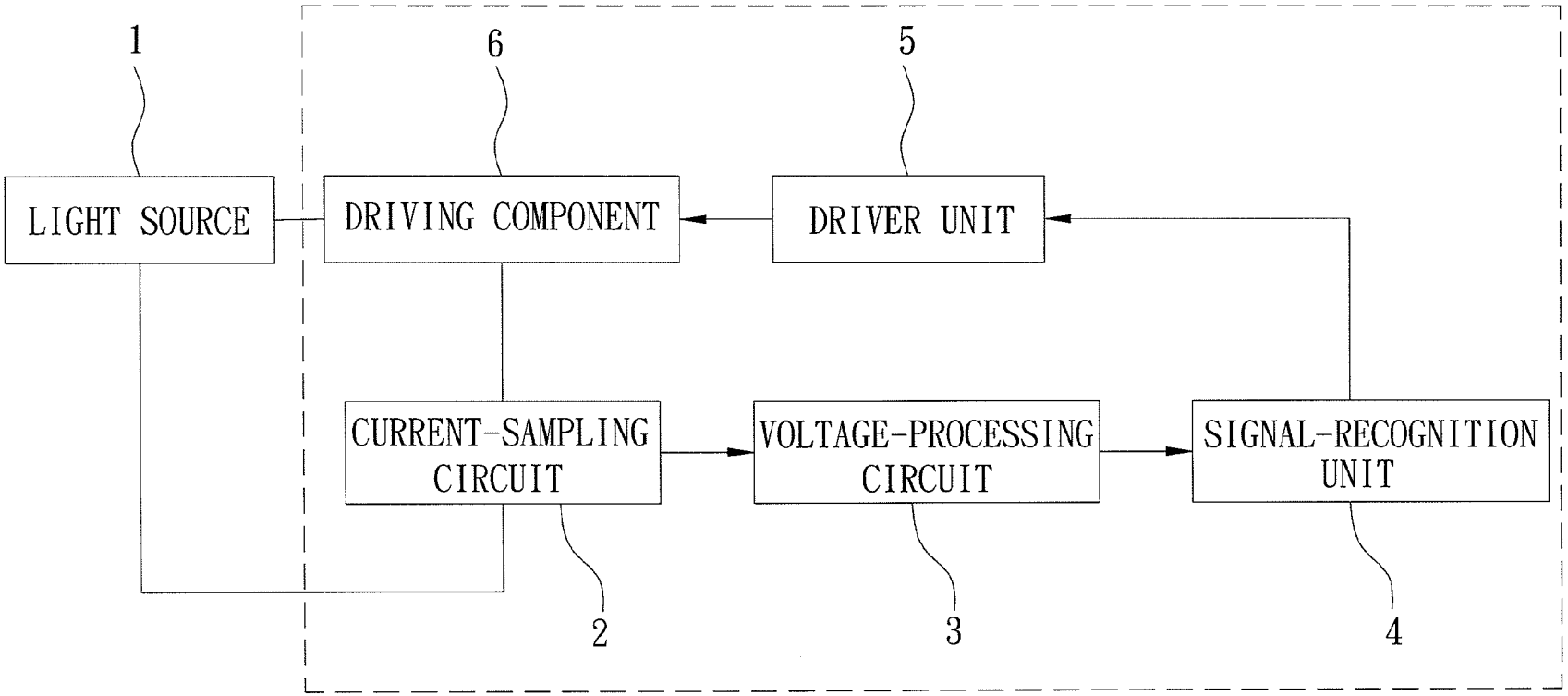
FIG. 1 is a block diagram to illustrate the preferred embodiment of a controller for a light fixture according to the present invention.

Referring to FIG. 1, the preferred embodiment of a controller according to this invention is suitable for use in a ceiling fan with a light fixture, and includes a current-sampling circuit 2, a voltage-processing circuit 3, a signal-recognition unit 4, a driver unit 5, and a driving component 6.

The current-sampling circuit 2 is adapted to be connected electrically to the light fixture, and is operable to generate a voltage signal corresponding to a current flowing through a light source 1 of the light fixture.

The voltage-processing circuit 3 is connected electrically to the current-sampling circuit 2 for receiving the voltage signal therefrom, and is operable to perform one of a voltage-amplification process, a voltage-rectification process, and a combination thereof upon the voltage signal so as to generate a recognition signal. In this embodiment, the voltage-processing circuit 3 performs both voltage-amplification and voltage-rectification upon the voltage signal. In this embodiment, the recognition signal is a digital signal. However, in other embodiments, the recognition signal may be an analog signal.

The signal-recognition unit 4 is connected electrically to the voltage-processing circuit 3 for receiving the recognition signal therefrom, and is configured to generate a control signal according to at least one waveform feature (i.e., signal duration, signal interval, etc.) of the recognition signal. The signal-recognition unit 4 is a processor in this embodiment.

Figure 2A:
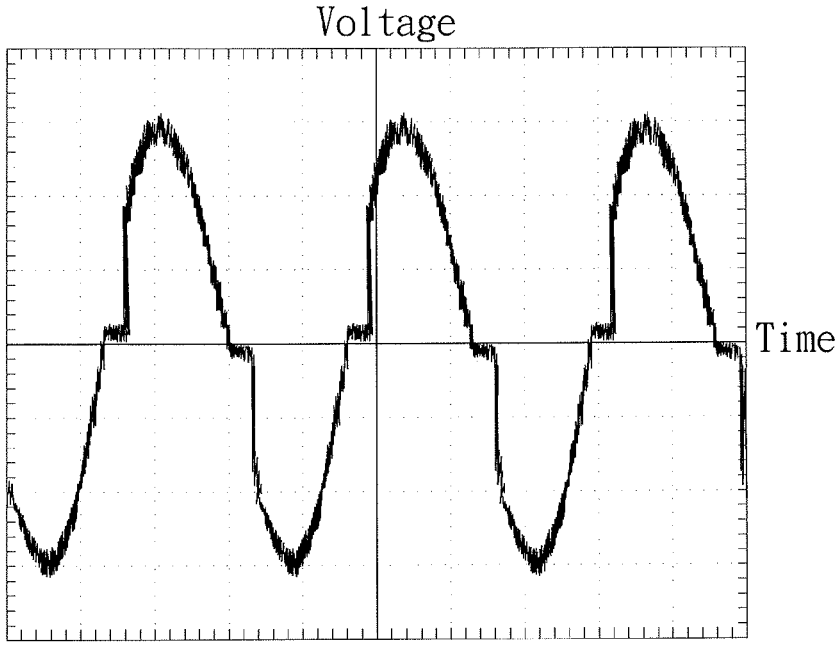
FIG. 2*a* is a screenshot of an electrical oscilloscope to show a recognition signal generated by a voltage-processing circuit of the controller when the controller is controlling operation of an incandescent lamp.
Figure 3A:
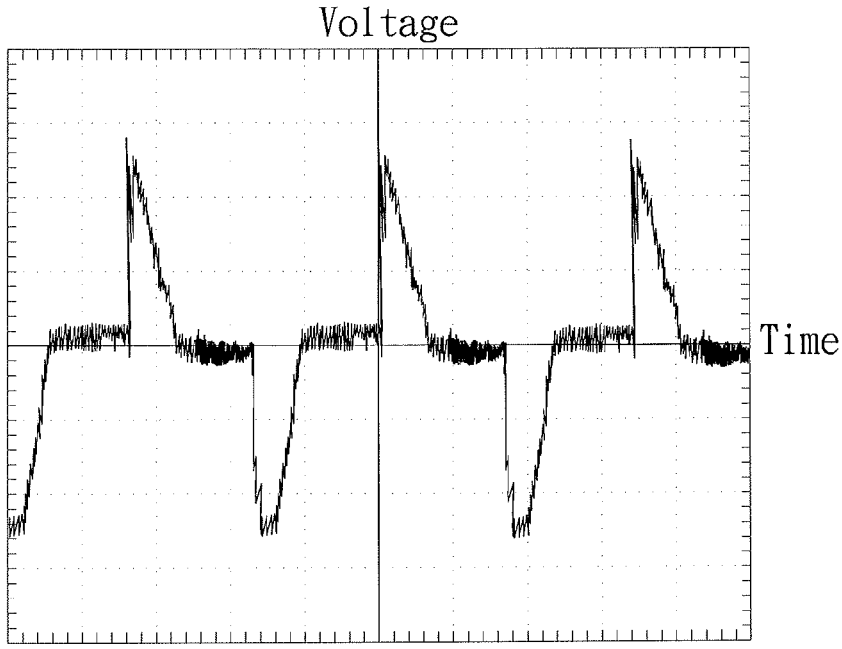
FIG. 3*a* is a screenshot of the electrical oscilloscope to show a recognition signal generated by the voltage-processing circuit of the controller when the controller is controlling operation of an electronic energy saving lamp.

FIG. 2*a* is a screenshot showing the recognition signal generated by the voltage-processing circuit 3 during operation when the light source 1 of the light fixture is an incandescent lamp. FIG. 3*a* is a screenshot showing the recognition signal generated by the voltage-processing circuit 3 during operation when the light source 1 of the light fixture is an electronic energy saving lamp. There is a noticeable difference between pulse widths in the signals of FIGS. 2*a* and 3*a*.

Figure 2B:
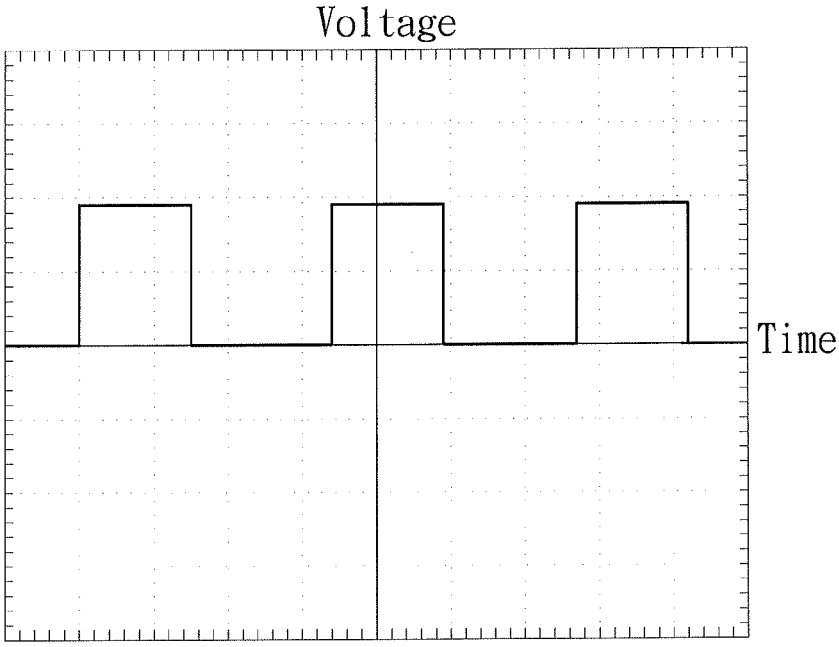
FIG. 2*b* is a screenshot of the electrical oscilloscope to show a control signal generated by a signal-recognition unit of the controller when the controller is controlling operation of an incandescent lamp.
Figure 3B:
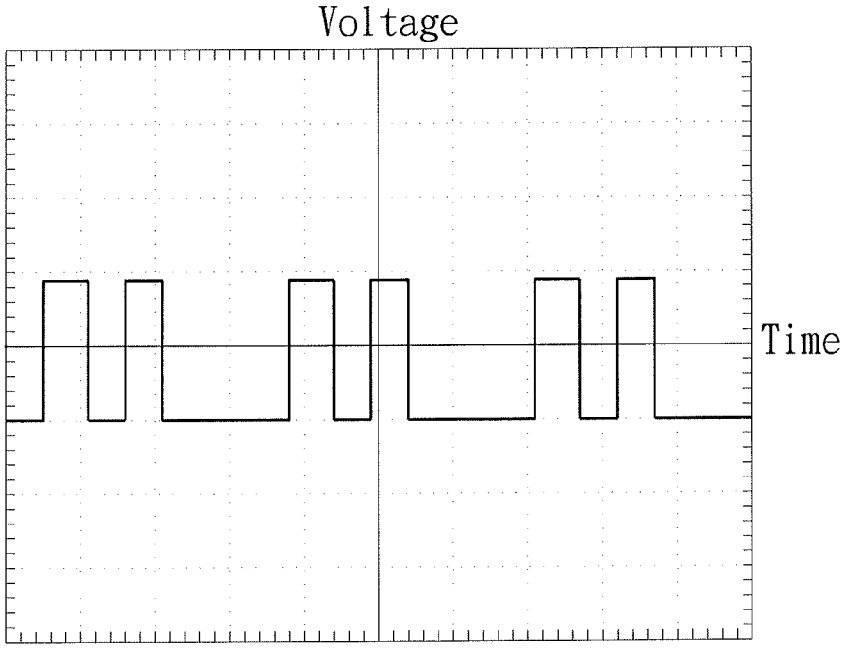
FIG. 3*b* is a screenshot of the electrical oscilloscope to show a control signal generated by the signal-recognition unit of the controller when the controller is controlling operation of an electronic energy saving lamp.

FIG. 2*b* is a screenshot showing the control signal generated by the signal-recognition unit 4 during operation when the light source 1 of the light fixture is an incandescent lamp. FIG. 3*b* is a screenshot showing the control signal generated by the signal-recognition unit 4 during operation when the light source 1 of the light fixture is an electronic energy saving lamp.

When the signal-recognition unit 4 determines from the recognition signal that the light source 1 of the light fixture is a first light source (such as an incandescent lamp or a light emitting diode lamp), the control signal generated by the signal-recognition unit 4 is for controlling on and off operations of the light source 1 and for brightness adjustment of the light source 1. On the other hand, when the signal-recognition unit 4 determines from the recognition signal that the light source 1 of the light fixture is a second light source (i.e., an electronic energy saving lamp), the control signal generated by the signal-recognition unit 4 is for controlling on and off operations of the light source 1 and not for brightness adjustment of the light source 1.

The driver unit 5 is connected electrically to the signal-recognition unit 4 for receiving the control signal therefrom, and is operable to generate a driver signal corresponding to the control signal. The driver unit 5 is a voltage converter (e.g., a transformer) in this embodiment, but may be an optical-control component in other embodiments.

The driving component 6 is connected electrically to the driver unit 5 for receiving the driver signal therefrom, is connected electrically to the light fixture, and is driven by the driver signal for controlling operation (i.e., power on, power off, brightness adjustment, etc.) of the light source 1 of the light fixture. The driving component 6 is a TRIAC in this embodiment.

It has thus been shown that the controller of the present invention is able to control operation of the light source 1, which may be an incandescent lamp, a light emitting diode lamp or an electronic energy saving lamp, of the light fixture based on a current flowing through the light source 1, thereby preventing the controller and the light source 1 from damage due to inappropriate control. In addition, generation of electromagnetic noise during operation of commercially available electronic energy saving lamps installed in the light fixture, which may affect operations of other nearby electrical appliances, may be alleviated through the controller of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A controller for a light fixture, said controller comprising:

a current-sampling circuit adapted to be connected electrically to the light fixture, and operable to generate a voltage signal corresponding to a current flowing through a light source of the light fixture;

a voltage-processing circuit connected electrically to said current-sampling circuit which receives the voltage signal therefrom, and is operable to perform one of a voltage-amplification process, a voltage-rectification process, and a combination thereof upon the voltage signal so as to generate a recognition signal;

a signal-recognition unit connected electrically to said voltage-processing circuit which receives the recognition signal therefrom, and configured to generate a control signal according to the recognition signal;

a driver unit connected electrically to said signal-recognition unit which receives the control signal therefrom, and is operable to generate a driver signal corresponding to the control signal; and a driving component connected electrically to said driver unit which receives the driver signal therefrom, adapted to be connected electrically to the light fixture, and driven by the driver signal for controlling operation of the light source of the light fixture;

wherein when said signal-recognition unit determines from the recognition signal that the light source is a first light source, the control signal generated by said signal-recognition unit is configured to control on and off operations of the light source and for brightness adjustment of the light source; and wherein when said signal-recognition unit determines from the recognition signal that the light source is a second light source, the control signal generated by said signal-recognition unit is configured to control on and off operations of the light source.

2. The controller as claimed in claim 1, wherein the first light source is one of an incandescent lamp and a light emitting diode lamp, and the second light source is an electronic energy saving lamp.

3. The controller as claimed in claim 1, wherein the recognition signal generated by said voltage-processing circuit is a digital signal.

4. The controller as claimed in claim 1, wherein the recognition signal generated by said voltage-processing circuit is an analog signal.

* * * * *